United States Patent [19]

Neyer

[11] 4,000,539

[45] Jan. 4, 1977

[54] HOLLOW KNOB

[75] Inventor: James U. Neyer, Lake Bluff, Ill.

[73] Assignee: Arens Controls, Inc., Evanston, Ill.

[22] Filed: Jan. 29, 1976

[21] Appl. No.: 653,358

[52] U.S. Cl. ..... 16/121; 292/347; 74/553

[51] Int. Cl.[2] ..... E05B 1/00

[58] Field of Search ..... 16/121, 118; 74/553; 292/347

[56] References Cited

UNITED STATES PATENTS

| | | | |
|---|---|---|---|
| 1,568,883 | 1/1926 | Danielson | 16/121 |
| 1,925,030 | 8/1933 | Burke | 16/121 |
| 2,199,018 | 4/1940 | Bahr | 16/121 |
| 2,633,758 | 4/1953 | Hobson et al. | 74/553 |

*Primary Examiner*—Andrew V. Kundrat
*Attorney, Agent, or Firm*—Olson, Trexler, Wolters, Bushnell & Fosse, Ltd.

[57] ABSTRACT

A hollow knob is provided for use on control shafts and the like. The knob comprises two hollow sections of plastic material and a metal insert threaded for receipt of a control rod or the like. The two hollow knob sections are provided with reinforcing ribs running at right angles to one another, and readily secured at crossover points by means of sonic welding. The metal insert is held securely in place in a well in one of the two plastic portions, being firmly trapped in place, and reinforcing the plastic sections.

8 Claims, 5 Drawing Figures

FIG.1
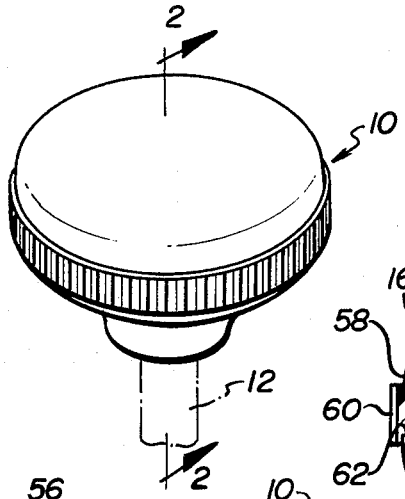
FIG.2
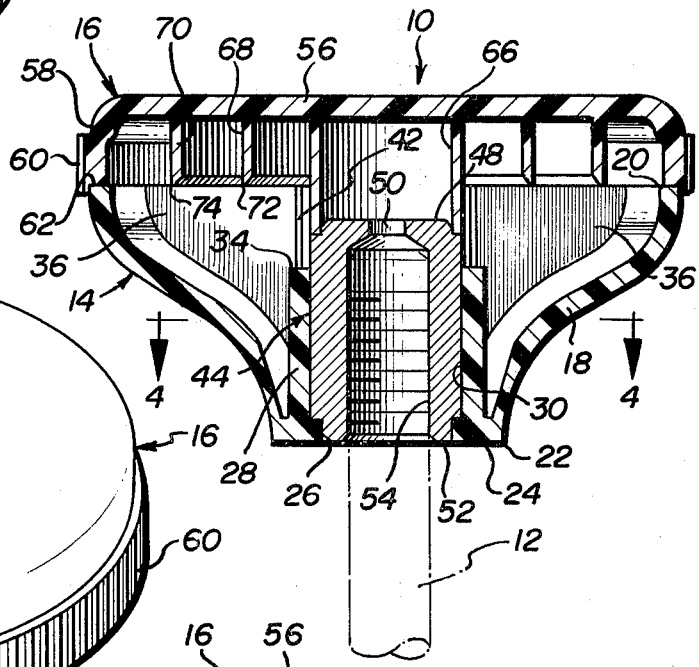
FIG.3
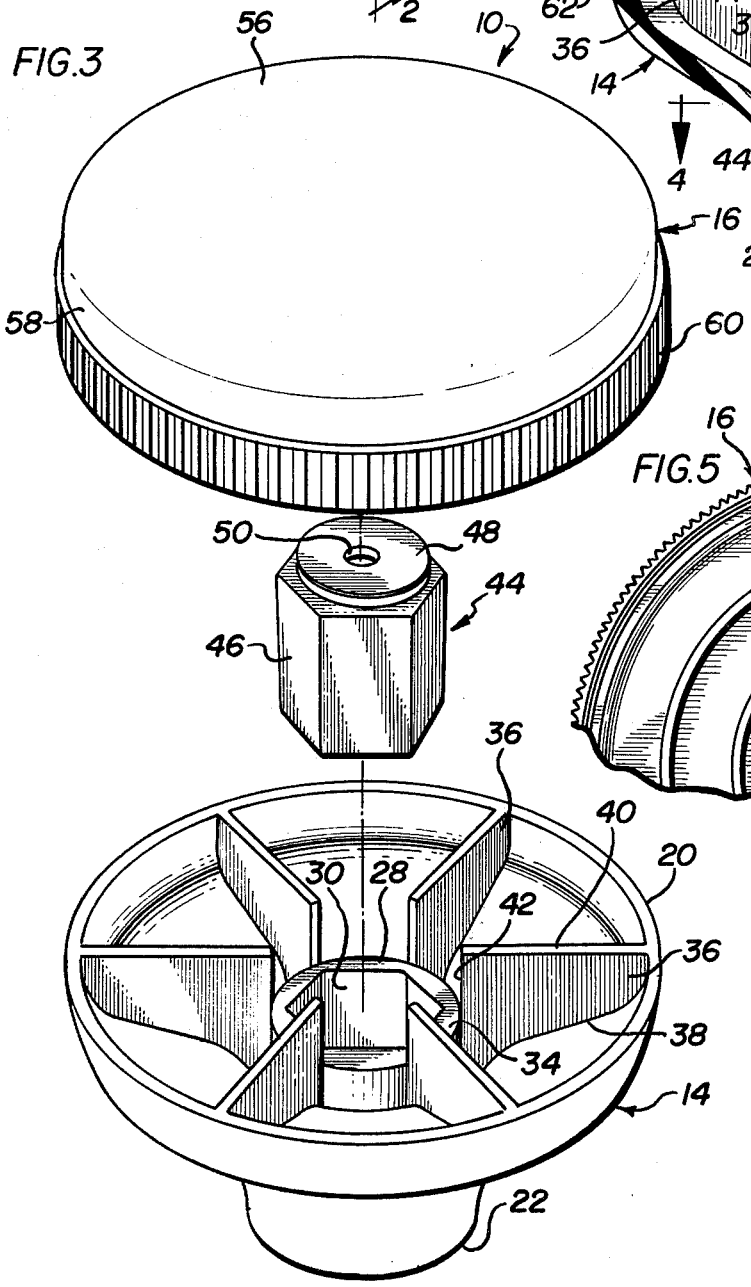
FIG.5
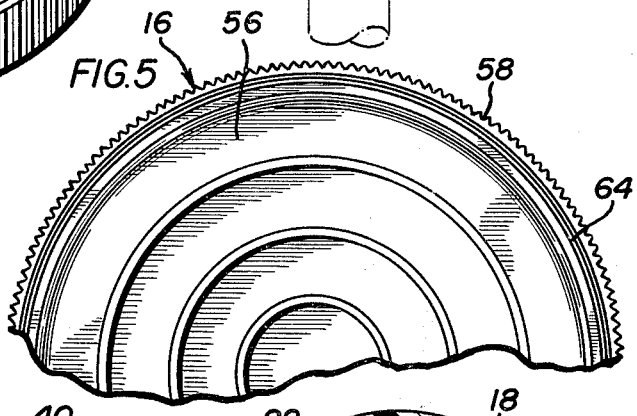
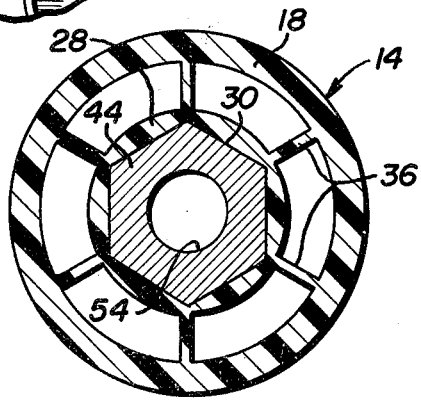
FIG.4

HOLLOW KNOB

BACKGROUND OF THE INVENTION

Plastic knobs have long been used as manually engageable elements threaded on the ends of control shafts or levers. Such knobs have conventionally been of solid construction. One common prior art construction has comprised styrene, a relatively cheap plastic material, molded about a metal bushing. Butyrate is molded on the outside of the styrene as it has a good appearance while in the past having been of reasonable price. The thin section of butyrate has made molding rather difficult.

Plastic materials used in the manufacture of such knobs have skyrocketed in price in recent years along with the price of petroleum, which comprises the usual basic raw material. By way of specific example, one plastic material widely used sold for something on the order of 15 cents per pound only a few years ago, while the same material now sells on the order of 50 to 60 cents per pound.

OBJECTS AND SUMMARY OF THE INVENTION

A principal object of the present invention is to provide a hollow plastic knob functionally equivalent in all respects to prior solid plastic knobs, yet utilizing far less material, hence minimizing costs and conserving precious raw materials.

In order to attain this principal object and various ancillary objects, a hollow knob is provided having a lower portion with a well in which a threaded metallic insert is disposed with radially directed ribs or fins running out from the well and reinforcing the sidewall of the knob. An upper knob portion engages peripherally with the lower portion with which it peripherally interfits. The upper portion has annular ribs which intersect the radial ribs of the lower portion at right angle crossovers, whereby the upper and lower portions reinforce one another without the necessity of accurate alignment of any sort during assembly. In addition, the upper portion is provided with a central tube which interfits with the upper end of the metallic insert, thereby reinforcing the upper wall of the knob. The lower end of the metallic insert extends to the lowermost extremity of the knob, whereby a jam nut threaded on the shaft adjacent the knob bears against the metallic insert, and does not stress the plastic material.

BRIEF DESCRIPTION OF THE DRAWINGS

The invention will best be understood with reference to the following description when taken in connection with the accompanying drawings, wherein:

FIG. 1 is a perspective view of a hollow plastic knob constructed in accordance with the present invention with the attendant shaft or rod shown in phantom;

FIG. 2 is an axially sectional view taken through the knob substantially along the line 2—2 in FIG. 1;

FIG. 3 is an exploded perspective view of the knob, showing the three parts thereof;

FIG. 4 is a transverse sectional view through the lower portion of the knob, as taken substantially along the line 4—4 in FIG. 2;

FIG. 5 is a view of the underside of the upper portion of the knob.

DETAILED DISCLOSURE

Turning now in greater particularity to the drawings, there will be seen a knob 10 constructed in accordance with the present invention and adapted to be screwed on the upper end of a shaft or control lever 12. The knob is of hollow construction and includes a lower portion or shell 14, and an upper portion or shell 16. The lower portion comprises a tapered annular sidewall 18 having a maximum diameter at its upper edge 20 and tapering down to a minimum outer diameter at the bottom edge 22, there being a transverse, flat lower face 24. The lower face 24 has a circular aperture 26, and an upstanding hexagonal wall 28 of greater transverse dimension than the diameter of the hole 26 forms a socket or pocket 30. The wall 28 is of less vertical height than the outer sidewall 18, whereby the upper edge 34 thereof is at a lower level than the outer upper edge 20, both of such edges being flat topped.

A plurality of radial flanges, ribs, or fins 36 is provided, each such flange having an outer edge 38 integral with the sidewall 18, a top edge 40 on a level with the top edge 20 and a radially inner edge 42 which is in part integral with the hexagonal wall 28, and in part ascends therefrom. There are six such ribs respectively radiating from the corners of the hexagonal pocket 30, and thus reinforcing the pocket at the areas of thinnest wall sections. Obviously a non-circular shape other than hexagonal could be used with a correspondingly different number of ribs.

A metallic insert or bushing 44 is provided for mounting snugly in the pocket 30, and has a hexagonal outer surface 46 for engagement with the walls of the pocket 30. There is a raised circular boss 48 on the top end, having a central aperture 50, the purpose of which will be set forth hereinafter. There is a similar and slightly longer boss 52 at the lower end of the insert which extends at least to, and possibly slightly beyond the lower flat face 24. The insert 44 is bored and tapped axially at 54. Often the knob may be screwed down tight against a flange or jam nut on the shaft or lever 12, and the extending boss 52 accepts the resultant axial force without stressing the plastic material. The insert simply fits snugly within the pocket 30 and is not specifically mechanically or adhesively secured in place.

The top portion 16 of the knob in the illustrative embodiment has a flat top 56. It is also contemplated that this top could be domed without departing from the invention. The edge of the top 56 is turned down at 58 as a peripheral flange, and is provided with a depending serrated rim 60. The rim 60 is provided with a recessed seat 62 which, prior to assembly, has an axially extending circumferential sharp, v-shaped rib 64 (FIG. 5).

The top portion 16 further is provided with a central hollow, cylindrical column 66 which depends below the remainder of the top portion, and is of proper length and diameter to receive the upstanding boss 48 on the insert 44. Finally, two annular flanges or ribs 68 and 70 are radially spaced from one another, and are axially disposed relative to the tubular column 66 and the serrated rim 60 and seat 62. These flanges or ribs 68 and 70 have sharp lower edges 72 and 74 respectively.

When the upper and lower portions of the knob are pressed together the assembly is submitted to ultrasonic welding. The sharp lower edges 72 and 74 of the ribs, and also the sharp flange 64 concentrate or direct the ultrasonic energy, thereby causing the confronting parts to weld together. This not only increases support but it keeps the upper portion of the knob from distorting during welding, since the ribs can penetrate each other further by more welding as more material is melted in the principal weld around the knob periphery. Since the ribs in the top are annular, no rotational alignment is needed between top and bottom, and right angle crossovers are assured, at which considerable welding energy is concentrated for effecting proper welding. After assembly a compressed air fitting (not shown) is threaded into the bore 54 of the insert, and compressed air under considerable pressure is applied. For this test procedure air at about two hundred pounds per square inch is applied, producing a total of about six hundred pounds force on the inner portion of the top of the knob. A properly welded knob will remain intact and is passed. Improperly welded knobs will separate under this force.

The plastic material of the knob is that generally known as ABS. This is a superior material which would be prohibitably expensive for a solid knob. Indeed, the total manufacturer's cost of the new hollow knob is less than one half the cost of the previous solid knob of styrene and butyrate. It is functionally identical to the solid knob, and basically of the same strength. It has better heat and scratch resistance. The molding cycle is much more rapid, about one third the time of a solid knob, due to the thinner walls. Furthermore, it is readily suitable to automatic assembly, including the sonic welding which takes place in less than 1 second. The molding cycle is about one third the time of that for a solid knob. Hence, labor costs are greatly reduced.

Furthermore, the new hollow knob is much lighter in weight than the previous solid knob, being about ½ oz. as compared with 1½ oz. for the prior art solid knob, and a great deal of cost is saved in shipping.

The knob is well adapted to hot stamping of indicia on the top surface thereof. As is well-known this is effected by the use of a heated metal stamp with a foil in between. Paint or the like on the foil comes off on to the surface of the knob. The knob is sufficiently rigid for this procedure, and also is sufficiently strong and rigid to take abuse in the field.

The metal insert is held rigidly in the assembly by being trapped between the two portions of the hollow plastic knob. This not only prevents axial movement of the insert within the knob, but supports the center of the knob top wall, thereby contributing to the rigidity of the knob. In addition, the metal insert is prevented from rotation by the confinement of its hexagonal shape within a hexagonal socket in the plastic. The lower portion of the insert, as heretofore noted, extends at least as far as the boundary of the plastic, thereby taking up axial stress as from a jam nut without having this stress applied to the plastic.

The hollow cylindrical column supports the top of the knob, as previously noted, and provides support for a large area of the knob, and yet does not result in any sink in the top of the knob due to the thinness of the column walls. The engagement with the upstanding boss on the insert assists in an accurate alignment in assembly and aids in preventing rocking of the insert in its socket. Additionally, this allows for accurate control of the height of the knob by locating the top and bottom shoulders of the insert adjacent to the respective plastic portions.

Throughout the specification and claims the terms "upper" and "lower" are for reference only. The parts could equally well be inverted or tipped sideways to a greater or lesser degree without changing the relative positions of the parts.

The specific example of the invention as herein shown and described is for illustrative purposes only. Various changes in structure will no doubt occur to those skilled in the art, and will be understood as forming a part of the present invention insofar as they fall within the spirit and scope of the appended claims.

The invention is claimed as follows:

1. A hollow plastic knob comprising a lower portion having a downwardly opening recess therein, a metallic insert in said recess for receiving a member to be moved by said knob, said lower portion having retaining means adjacent said recess for trapping said insert in said recess, and a top portion secured to said bottom portion and having a part thereof bearing against said insert adjacent the upper end to hold said insert against said retaining means and for bracing said upper portion, said portions having relatively transverse ribs reinforcing the respective portions and having cross-overs at which said ribs are secured to one another.

2. A knob as set forth in claim 1 wherein the ribs of one portion are radial and the ribs of the other portion are annular.

3. A knob as set forth in claim 2 wherein the radial ribs are in the lower portion, and the annular ribs are in the upper portion.

4. A knob as set forth in claim 3 wherein said recess in cross section comprises a polygon having corners, and wherein the lower portion ribs radiate from said corners.

5. A knob as set forth in claim 3 wherein the part of said upper portion engaging said insert comprises a hollow tubular column and said insert has an upper boss extending into said column.

6. A hollow plastic knob comprising a lower portion having a downwardly opening recess therein, a plurality of bracing ribs in said lower portion integral with the sidewalls of said lower portion and radially disposed, and a top portion secured to said bottom portion and having annular reinforcing ribs therein, the ribs of the respective parts having crossovers at which said ribs are secured to one another.

7. A knob as set forth in claim 6 wherein the radial ribs of the lower portion are integral with and radial of the sidewall of said recess, thereby bracing the same.

8. A knob as set forth in claim 6 wherein the upper and lower portions have complementary rims, said rims and the crossovers of said ribs being respectively secured together by ultrasonic welding.

* * * * *